US006550585B2

(12) United States Patent
Schoppa et al.

(10) Patent No.: US 6,550,585 B2
(45) Date of Patent: Apr. 22, 2003

(54) HOISTWAY INTRUSION DETECTION

(75) Inventors: Wolfgang M. Schoppa, Vehlefanz (DE); Axel Steffen Gerwing, Berlin (DE)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 10/059,632

(22) Filed: Jan. 29, 2002

(65) Prior Publication Data

US 2002/0117358 A1 Aug. 29, 2002

(30) Foreign Application Priority Data

Feb. 23, 2001 (DE) ..... 101 08 772

(51) Int. Cl.[7] ..... B66B 1/34
(52) U.S. Cl. ..... 187/391; 187/280
(58) Field of Search ..... 187/280, 391, 187/392, 277, 390, 316, 317, 393; 382/103, 325

(56) References Cited

U.S. PATENT DOCUMENTS 5,025,895 A * 6/1991 Leone et al. ..... 187/277
5,347,094 A * 9/1994 Leone et al. ..... 187/390
5,644,111 A * 7/1997 Cerny et al. ..... 187/393
6,050,369 A 4/2000 Leone et al. ..... 187/392
6,138,798 A * 10/2000 Macuga ..... 187/294
6,467,585 B1 * 10/2002 Gozzo et al. ..... 187/391

FOREIGN PATENT DOCUMENTS

| | | | |
|---|---|---|---|
| DE | 195 22 760 A 1 | 10/1997 | |
| JP | 02169482 | 6/1990 | |
| JP | 03079571 A * | 4/1991 | ..... B66B/1/16 |
| JP | 04007282 A * | 1/1992 | ..... B66B/5/00 |
| JP | 04327475 A * | 11/1992 | ..... B66B/3/00 |
| JP | 07237838 | 9/1995 | |
| JP | 09286576 | 11/1997 | |

* cited by examiner

*Primary Examiner*—Jonathan Salata

(57) ABSTRACT

Elevator, exhibiting an elevator shaft (34) and a car (32) which is movably provided inside the elevator shaft (34), and a safety installation (2), which is designed in such a way that it can take the elevator out of service in a dangerous situation, characterized by the fact that the safety installation (2) is equipped with a shaft monitoring device.

12 Claims, 3 Drawing Sheets

HOISTWAY INTRUSION DETECTION

TECHNICAL FIELD

The invention pertains to an elevator exhibiting an elevator shaft, an elevator car which is movable inside the elevator shaft, and a safety installation which is designed in such a way that it can take the elevator out of service in a dangerous situation.

BACKGROUND ART

Everyday life, especially, in cosmopolitan areas, is no longer imaginable without elevators. Elevators are being employed for very diverse applications, e.g., for use in buildings with only relatively few floors (3 to 5 floors) and in relatively tall buildings of, sometimes, substantially more than 50 floors. Elevators are equipped with extremely diverse drive systems. There are those with a friction-driven hoisting motor, which, for instance, may be provided in the upper area of the elevator shaft. These types of elevators frequently are equipped with a counterweight unit that is suspended on the same hoisting cable as the elevator car, which runs in the opposite direction to the elevator car. In addition, there are those elevators, in particular, which are used to service only relatively few floors, so-called hydraulic elevators, with or without a counterweight, in which the elevator car is moved by a hydraulically moved pressure piston. Sporadically, there are also elevators in which the driver is provided on the elevator car directly and which is, for example, designed as a rack and pinion drive, or wheel and disk drive.

In all of these different elevator types, assuring that only maintenance staff or other authorized individuals enter the elevator shaft presents a fundamental problem. In order to solve this problem, elevators typically have a safety installation which is equipped with various sensors and which, upon detecting a dangerous situation—which is defined in accordance with specific prerequisites—will take the elevator out of service. The acuteness of this problem which, in the past, essentially, only affected elevator operators or maintenance personnel has, most recently, skyrocketed due to the presence of "elevator surfers," and, more specifically, due to the determination with which these elevator surfers seek to bypass the safety installation. As a result of this development, safety installations which, until recently, were still deemed satisfactory, have turned out to be inadequate.

A typical safety device is equipped with hatch door contacts on each hatch door which are frequently electronically connected in series, whereby the opening of one single hatch door contact breaks the connection between the power supply and the drive motor. Besides that, additional safety switches exist in the elevator shaft in maintenance-relevant locations, or in locations which pose particular safety problems, namely, specifically, the so-called PES (pit emergency stop), or the pit emergency switch, as well as the TCI (top of car inspection) which is provided on the top of the car and is operated by a mechanic who climbs on top of the car for maintenance purposes. These two switches are frequently also provided in series with the door contact switches. If one of these switches of the safety chain is opened, the connection between the power supply and the drive motor is broken and the elevator car stops in the position it has assumed. Normally, this safety chain is directly connected to the elevator control system. In addition, the PES and the TCI are separately connected to the elevator control system and, apart from that, additional information concerning the current position of the car, etc., is fed to it. The elevator control system software differentiates between the safety chain's signals in their evaluation. Thus, it is quite obvious that, each time the car makes a normal stop on any floor and with every associated opening of the door, the appropriate door safety contact is opened for a short period and the connection between the power supply and the driver is broken. After the door contact has closed, the safety chain is also closed again as a whole, the power supply to the driver is restored, and the elevator can, quite routinely, start on its way to the next destination stop. If, however, the hatch door, e.g., is opened manually when the car is not in a position that is in flush alignment with an opening on a floor, the car, depending upon software control of the equipment, can be taken out of service permanently, and the elevator operator, or a mechanic who might be called, must inspect the equipment and restart its operation.

Although, over the years, this type of safety installation has proved to be reliable, serious and, in some cases, also fatal, accidents have repeatedly occurred, e.g., either when trained personnel did not correctly adhere to the safety instructions because of time pressures or established routine or when unauthorized individuals forced their way into the elevator shaft. For instance, due to the design of the safety chain with series-connected door contact switches, it is possible for elevator surfers manually to open the door one floor above the regular stop location of the elevator car while the subjacent door is open, so that passengers can exit and board, and to close the door again within the same time period. The elevator surfer then stands on top of the elevator car and the elevator safety installation has failed to acknowledge the fact that a second door was opened manually.

An additional typical accident scenario is the following: one of the passengers has dropped a key into the shaft pit through the gap between the car and the landing floor, and the building's elevator operator is called for assistance. He sends the car off from the bottommost landing floor and opens the door on the landing floor with the appropriate unlocking key. Then, he blocks the door on the landing floor with an inappropriate tool (for example, a screwdriver) and climbs into the shaft pit without operating the pit emergency switch that is mounted there. If the screwdriver, which is to serve to secure the door on the landing floor, slips out now, it may happen it will close and the car will begin to move. In such a situation, the typical result is a correction run, i.e., the car will run to one of the end points of its path of movement, that is, all the way to the bottom.

Another situation may occur if a maintenance mechanic wishes to step on the elevator top for maintenance purposes. For this purpose, he calls the car to his landing floor and ensures that there are no passengers inside the car. He then sends the car down far enough that he can easily reach the elevator top, and he opens the door on the landing floor with the corresponding unlocking tool. He then enters the top of the car and, even before he is able operates the top of car emergency switch, he stumbles. In this case, the door on the landing floor also closes and the elevator continues its operation in the usual manner because the safety installation is unable to recognize this dangerous situation.

DISCLOSURE OF INVENTION

In this context, it is the objective of the present invention to configure the safety installation of an elevator in such a way that, as a general rule, the elevator will be taken out of service when unauthorized people enter the elevator shaft.

In accordance with the invention, this objective is realized by means of the fact that the safety installation is equipped with a shaft monitoring device.

It is not mandatory that the shaft monitoring device monitor the entire elevator shaft. For instance, essential partial areas of the elevator shaft to be monitored are the top of the car, on the one hand, and the shaft pit, on the other hand. The shaft monitoring device may, especially preferably, but need not be designed in combination with the mentioned safety installation in the way of a safety chain. Specifically, this type of shaft monitoring device is able to detect an unauthorized entry into the shaft even without the added safety chain, and can take the elevator out of service. Preferably, the shaft monitoring device is equipped with at least one motion sensor. This may either be an ultrasound or an infrared motion sensor. As a rule, these types of motion sensors are manufactured in large lots for the most diverse applications and can, accordingly, be purchased inexpensively. Naturally, other types of automated motion sensors are conceivable, as well; for instance, video cameras which are connected to an image analyzer. Alternatively, or in addition to motion sensors, a load-sensitive mat may also be provided on top of the car and/or in the shaft pit, which, under load, will transmit a signal to the safety control system or open a switch in the safety chain.

The shaft monitoring device preferably monitors the shaft in the vicinity of the shaft pit and/or in the area of the top of the car. As a rule, these are the only areas in the elevator shaft in which a human being can spend time relatively easily. In the case in which the horizontal surface of the counterweight is large enough, it is also conceivable that a shaft monitoring device could be provided for this area.

Preferably, a motion sensor is provided in such a way that the movement of the hatch doors will not be detected by the motion sensor. This arrangement will facilitate the avoidance of a disturbance or an erroneous signal transmission due to a movement of the hatch doors. In general, motion sensors have a specific, well-defined horizontal and vertical angular field which they are capable of covering. Therefore, essentially, it may be more advantageous to arrange the individual motion sensors on the shaft wall on which the hatch doors are located and to have the "critical periphery" of the angular field graze past it linearly, essentially parallel to the hatch door opening. Thus, on the one hand, it is ensured that the entry of a person through the hatch door opening will always be detected. Yet, on the other hand, specifically, the movement of the hatch door will no longer be monitored by the sensor.

The shaft monitoring device is preferably connected to a safety control system, which is designed in such a way that after it takes the elevator out of service due to a dangerous situation, it will automatically reset the elevator to its normal operating state, if the shaft monitoring device was unable to detect anything in the shaft over a predetermined extended period and the rest of the sensors of the safety installation also do not display any irregularities over the same period. The advantage of this design shall be described by means of a brief example: because he has heard some noise in the elevator shaft, the elevator operator opens the hatch door and looks into the elevator shaft. The shaft monitor detects that the head has entered the shaft and, thereupon, stops the operation of the elevator. Because the elevator operator could not find anything, he shuts the door again. If, after that, the shaft monitoring device does not detect anything peculiar over a specific extended period, the safety control system assumes that no one is in the elevator shaft any more and automatically resets the elevator to its normal operating state. The predetermined extended period is normally set, so that it can be presumed that a person who is in the elevator shaft would have moved in the meantime, or would have been detected by the shaft monitoring device otherwise. Typical time periods are approximately 5–10 minutes. This time period may appear lengthy from the viewpoint of passengers waiting in front of the elevator doors. However, it is relatively short compared to the time which would elapse if the elevator was manually reset to its normal operating state.

Preferably, the shaft monitoring device is connected to a safety control system that only uses the signals of the shaft monitor while the car is stopped in order to detect dangerous situations. An examination of a motion sensor on top of the car shows that with the elevator in motion, the shaft wall moving past it will be detected as a moving object. If the safety control system were also to use the signals of this sensor in order to detect a dangerous situation while the elevator car is in motion, it would take the elevator out of service each time the car starts up. This similarly applies to other sensors provided in the shaft and the shaft pit which, e.g., may erroneously identify the moving elevator car or the counterweight, the compensating ropes, or other moving parts, as unauthorized objects or people in the elevator shaft. Theoretically, it is true that this problem could also be avoided through an appropriate adjustment of the sensors, but in order to prevent faulty responses with a relatively high degree of reliability, and in order to utilize the entire angular field of the sensors, it is preferable to use the signals of a motion sensor for the detection of dangerous situations only while the car is halted. However, especially in the shaft pit, it might make sense continuously to use the signals of the shaft monitor which is mounted there in order to detect a dangerous situation. On the one hand, only a relatively limited number of moving parts are located there that can, for instance, be covered with screens, or made undetectable by appropriately positioning the sensors of the shaft monitoring device. Generally, in the vicinity of the shaft pit, the probability that a person will enter this area while the car is moving is relatively high. It is true that, normally, the shaft pit is secured due to the fact that the bottommost hatch door is secured by a hatch door contact or that a separate shaft pit hatch is also secured by a separate contact. However, here, the shaft monitoring device provides an additional safety network in the event that this safety contact should fail.

Preferably, the signals of the shaft monitoring device will be used while the car is moving, in order to check the functions of the shaft monitoring device. The fact that while the car is moving the shaft monitoring device typically transmits motion signals to the safety control system can be used for a function check of the individual sensors of the shaft monitoring device either at intervals or continuously. If the safety control system detects that one or more motion sensors of the shaft monitoring device does or do not transmit any motion signals while the car is moving, it can be assumed that a defect is present. The function control option of the shaft monitoring device, as a side effect of a continuous operation, so to speak, should not be underestimated as an additional safety feature.

Moreover, the present invention pertains to a process for the retrofitting of a shaft monitoring device in an existing elevator with a safety installation which is designed in such a way that in a dangerous situation which has been recognized as such by the safety installation, it can take the elevator out of service, which is characterized by the fact that a shaft monitoring device is provided; the shaft monitoring device is installed in the elevator shaft; the shaft monitoring device is connected to the safety installation, and a function check is performed.

The present invention turns out to be particularly valuable due to the fact that it is possible relatively easily to retrofit already existing elevator facilities with safety installations due to the relatively simple installation of the shaft monitoring device, and to update them to the latest state of the art safety technology. Especially in view of the extremely long operating times of typical elevators in buildings, some of which are 50 years or more, the retrofitting of existing facilities to the latest state of the art is always an important issue. The conspicuously simple solution of the present invention facilitates this retrofitting especially easily.

Specifically, this retrofitting is also possible in cases in which the safety control system of the elevator itself is still basically designed to also process the additional signals of the shaft monitoring device. In this case, an internal safety control system may be provided for the shaft monitoring device which, for instance, can receive control signal information to the driver concerning whether the car is presently at a landing floor or is moving between two landing floors. The signals of the individual sensors of the shaft monitoring device are fed to the safety control system of the shaft monitoring device and the latter determines whether a relay, which is present in the safety chain of the elevator in the way of a hatch door contact, will be opened or remain closed. In this manner, the retrofitted shaft monitoring device can, in principle, essentially be used to completely retrofit any elevator regardless of the conditions present in the facility. Preferably, the step of installing the shaft monitoring device includes the mounting of the shaft monitoring device in such a way that it will at least survey either the shaft pit or the top of the car.

BEST MODE FOR CARRYING OUT THE INVENTION

Figure 1:
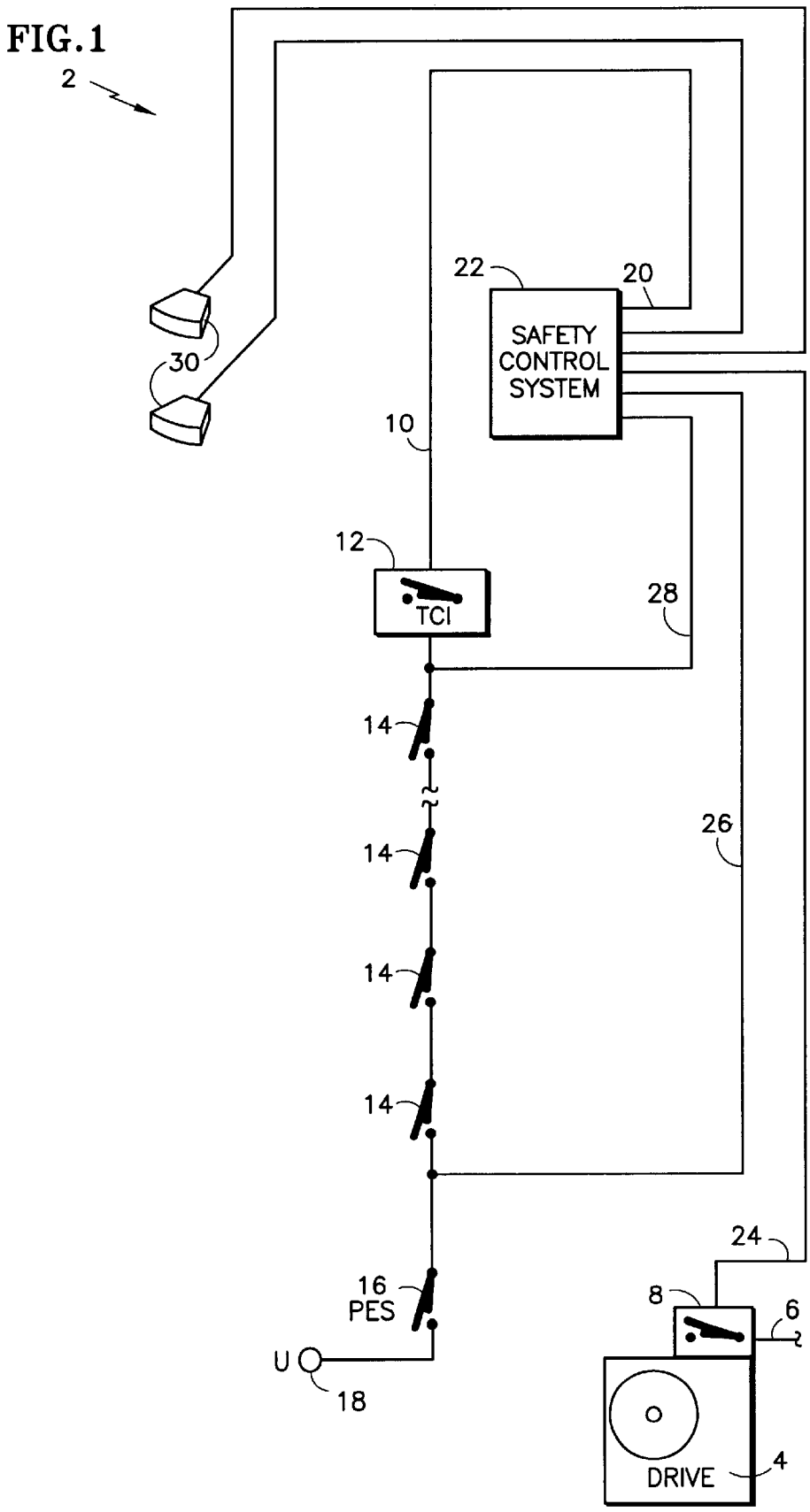
FIG. 1 is a schematic showing the appearance of a safety installation for an elevator in accordance with the invention.

FIG. 1 shows the safety installation (2) of an elevator in accordance with the invention in interaction with a driver (4) for the elevator. The driver (4) is a driver (4) with a drive pulley for the hoisting cable from which the car and the counterweight are suspended. However, any other type of driver (4) is also conceivable. In the driver (4), one can discern an electric power cable (6) which provides the power supply of the driver (4) via a contactor (8). Overall, we point out that, especially the representation of FIG. 1 is extremely schematic, and that, as a rule, the circuit configuration is actually much more complex than FIG. 1 shows. In the safety installation (2), one specifically recognizes the safety chain (10) in which a number of switches (12, 14, and 16) are configured in a series connection. A voltage (U) is applied to the end of the safety chain (10) which is designated 18. The other end (20) of the safety chain is connected to a safety control system (22). In general, it can be said that an open switch (12, 14, or 16) represents an unsecured state of the elevator. If one of the switches is open, no voltage will be applied to the safety control system at 20. In this case, the safety control system (22) switches the driver (4) to zero current via the line (24) and the relay (8). To be detailed, various types of switches are located in the safety chain (10). Switch 16 is the so-called PES (pit emergency stop) switch that is provided in the shaft pit. If a mechanic or an elevator operator enters the shaft pit, he must operate the pit emergency switch (16), and, thereby shut down the facility, in accordance with maintenance instructions. If he does so, this guarantees that the elevator car will remain at a halt during the time he spends in the shaft pit, and that, especially from above, nothing can come dangerously close to him. A branch line (26) is conducted directly to the safety control system (22) from the pit emergency switch (16) so that the safety control system (22) receives information separately through the operation of this special switch.

So-called hatch door contacts (14) are provided on each of the hatch doors, so that the power supply to the driver (4) is also interrupted when the hatch door is open. One can deduce that while, via the line (28), the safety control system does receive the information that one of the hatch doors is open, i.e., that one of the hatch door contacts (14) is open, the safety control system, however, has no information at all concerning which of the hatch doors is open; specifically, the safety control system (22) also does not recognize whether an additional hatch door is opened after a first hatch door has been opened.

An additional emergency stop switch is provided on the top of the elevator car. This is the top of the car emergency stop switch (12), which generally is called the TCI (top of car inspection). In FIG. 1, the TCI (12) is drawn as a box. This is to indicate that it is not only a switch for opening or closing. Instead, at least two additional switches are assigned to the TCI (12) which are called the UIB and the DIB (Up-Inspection Button and Down-Inspection Button), respectively. By means of these switches, the mechanic is able to move the car up or down at slow travel when the TCI (12) is open. One can deduce from this that, e.g., the line connection between the TCI (12) and the safety control system (22) is much more complicated than represented in FIG. 1. In FIG. 1, one further recognizes two shaft monitoring sensors (30) in the form of motion sensors which are not integrated in the safety chain, but feed to separate inputs of the safety control system (22).

Figure 2:
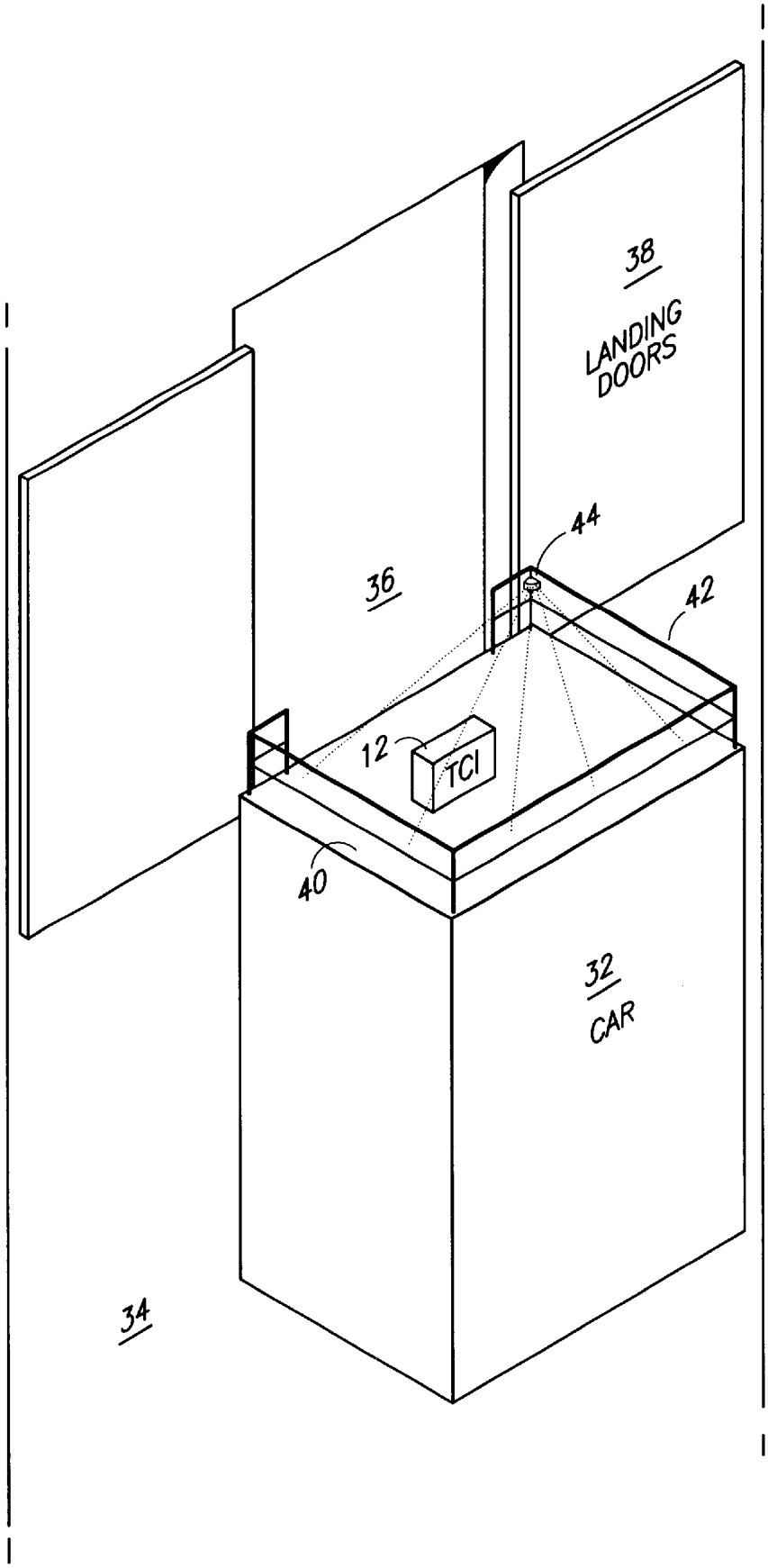
FIG. 2 is an elevator in accordance with the invention with a shaft monitoring device which is provided on top of the elevator car.

In FIG. 2, one discerns an elevator car (32) inside an elevator shaft (34). Furthermore, one recognizes an opening on a landing floor (36), as well as landing floor doors, or hatch doors (38). The car (32) itself may be equipped with car doors of its own. For example, multiple cars (32) which can move up and down adjacent to each other may be provided in one shaft. One further recognizes the top (40) of the elevator car, as well as a railing (42) which is provided in the vicinity of the elevator car top (40), which prevents a mechanic located on the elevator car top (40) from falling off. On the elevator car top itself, one further recognizes the top of car emergency stop switch TCI (12). For safety reasons, a mechanic or elevator operator entering the top of the car (40) must immediately operate the TCI, so that the power supply to the driver (4) will be interrupted.

With the present invention, a shaft monitoring device is provided as an additional safety network. A motion sensor (44) is located for this purpose on the top (40) of the elevator car (32). In the embodiment example shown, the motion sensor (44) is affixed to the railing (42). However, it may as easily be provided on another building component. Preferably, the sensor is provided at a specific predefined distance above the uppermost level of the top (40) of the car since, typically, objects and devices are provided on the top of the car (40) that might interfere with the sensor range. Therefore, the sensor is arranged at a sufficient height above these objects and devices, in order to be able to "look over" them. A distance of at least 40 cm above the top of the car is especially preferred. Moreover, in the vicinity of the hatch doors (38), and, with its observation field, the motion sensor (44) is provided, so that it is directed away from the hatch doors (38). This ensures that the movement of the hatch door (38) will not be detected by the motion sensor (44). An ultrasound sensor or infrared sensor, e.g., may be provided as a motion sensor (44). The sensitivity of the sensors must be such that any individual gaining entry to the top of the car (40) will reliably be detected.

In order to avoid a disturbance of the motion sensor (44) by the second elevator car in a shaft in which two elevator cars are provided, so that they move independently of one another, it is preferred that the motion sensors (40) be arranged in such a way that a moving second elevator car will also not be detected by the motion sensor. The same applies to any moving parts which might potentially be provided inside the shaft, for instance, the counterweight of an additional elevator, or electric cables, hoisting cables, etc. Alternatively, or additionally, optical screens, for instance, in the form of sheet metal partitions may be provided which will prevent the motion sensor (44) from being affected in an undesirable manner.

Figure 3:
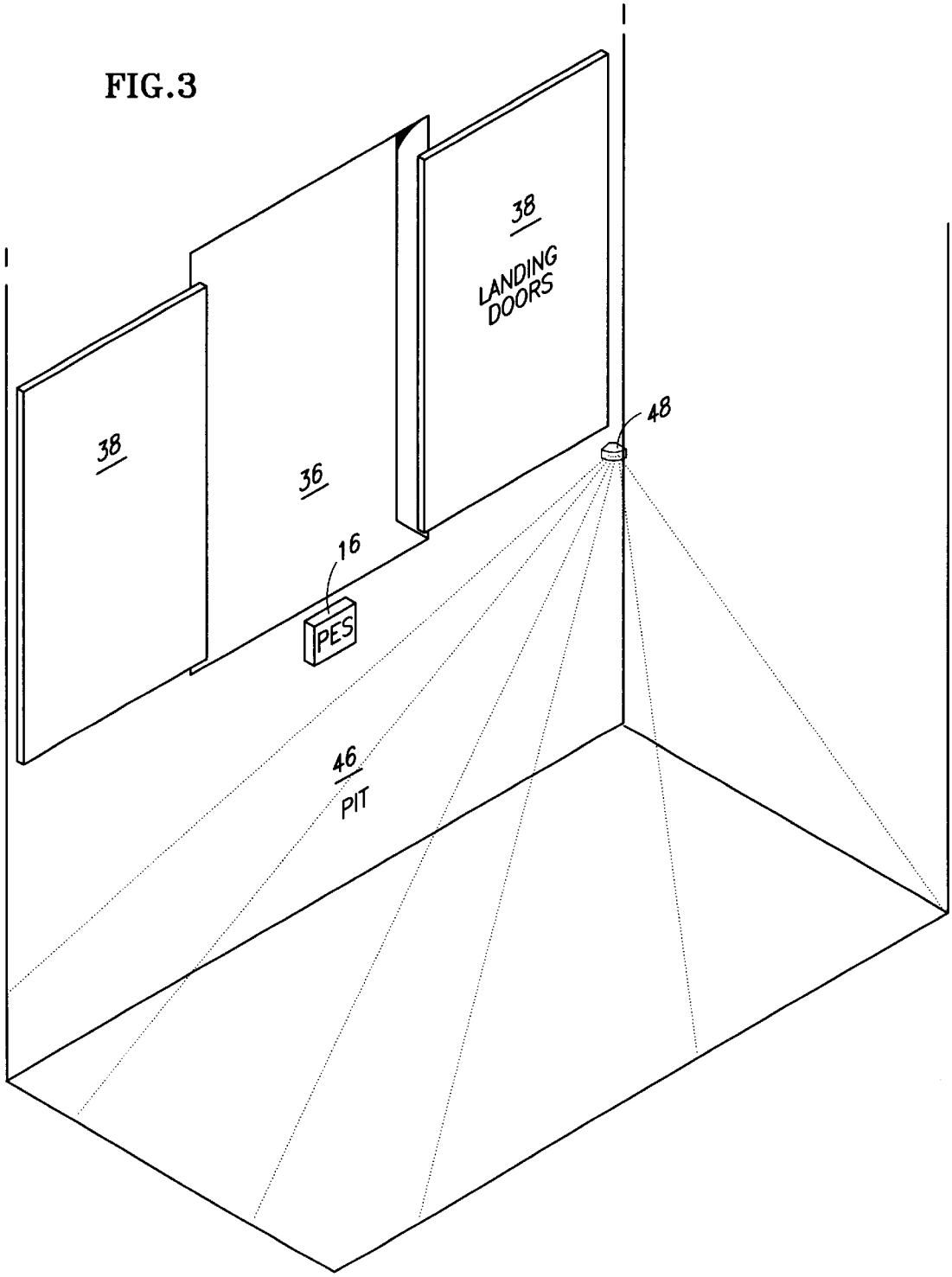
FIG. 3 is an elevator in accordance with the invention with a shaft monitoring device which is provided inside the shaft pit.

The shaft pit (46) is shown in FIG. 3. Specifically, the pit emergency switch PES (16) is shown, which, for safety reasons, the mechanic must operate when climbing into the pit. The sensor (48) of the shaft monitoring device, which, advantageously, is also designed as a motion sensor (48) can also be seen. It is also arranged in such a way that the movement of the hatch doors (38) or the movement of other moving parts in the elevator shaft will not be erroneously identified as a person entering. Here, the motion sensor (48) is also provided at a certain height above the bottom of the shaft pit.

Based on the description provided thus far, it can be noted that, specifically, the motion sensor which is arranged on the top of the elevator car (40), naturally reports motion signals to the control circuit (22) during the entirely normal running operation of the car. These signals must not result in cutting off the power supply to the driver (4). For this reason, the safety control system (22) only generates a signal for disconnecting the power supply as a result of motion signals of the motion sensor (44) if the elevator car is at a stop. Because the movement of the car (32) in the elevator shaft (34) frequently also results in the movement of some objects in the area of the shaft pit (46), the same applies to the motion sensor (48). However, it is conceivable that no parts are arranged in the shaft pit (46) that move during travel of the elevator car (32). In that case, the safety control system (22) may be connected in such a way that the power supply will be disconnected upon every motion signal from the motion sensor (48) in the shaft pit (46).

In addition to or in place of motion sensors (44 and 48), it is also possible to provide load-sensitive mats on the top of the car (40) and on the bottom of the shaft pit (46) which will output a signal to the safety control system (22) when a person enters. Correspondingly, the shaft monitoring device may also be constituted by these types of pressure-sensitive safety mats. They may also be provided, for instance, directly in the safety chain (10) via a relay that will open a switch if a person steps on the safety mats. The wired connection of the sensor of the shaft monitoring device, which moves along with the elevator car (32), to the safety control system (22) can be established via the standard line connections of the car in a quite normal manner.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

We claim:

1. An elevator system including an elevator shaft and a car, which is movable inside the elevator shaft, and a safety installation, which is designed in such a way that it can take the elevator out of service in a dangerous situation, said safety installation comprising:

a shaft monitoring device for generating a signal; and a safety control system connected to the shaft monitoring device wherein the safety control system, is responsive to the signal for the detection of a dangerous situation when the car is at a halt and for determining the functional status of the shaft monitoring device while the car is in motion.

2. The elevator system of claim 1 wherein said shaft monitoring device further comprises at least one motion sensor.

3. The elevator system of claim 2 wherein said shaft monitoring device monitors the shaft in the vicinity of the shaft pit.

4. The elevator system of claim 2 wherein said shaft monitoring device monitors the shaft in the vicinity of the top of the car.

5. The elevator system of claim 4 wherein the motion sensor is arranged in such a way that the movement of the hatch doors will not be detected by the motion sensor.

6. The elevator system of claim 2 wherein said shaft monitoring device is connected to a safety control system wherein the safety control system is designed in such a way that after the elevator has been taken out of service due to a dangerous situation, it will automatically reset the elevator to its normal operating state if the shaft monitoring device was unable to detect anything inside the shaft for a predetermined extended period of time.

7. The elevator system of claim 1 wherein said shaft monitoring device further comprises at least one load sensitive mat.

8. The elevator system of claim 7 wherein said shaft monitoring device monitors the shaft in the vicinity of the shaft pit.

9. The elevator system of claim 7 wherein said shaft monitoring device monitors the shaft in the vicinity of the top of the car.

10. Method for retrofitting a shaft monitoring device in an existing elevator with a safety installation which is designed in such a way that it can take the elevator out of service in a dangerous situation which is recognized as such by the safety installation comprising the steps of:

providing a shaft monitoring device;

mounting the shaft monitoring device in the elevator shaft;

generating a signal by the monitoring device upon detection of movement in the elevator shaft;

connecting the shaft monitoring device to the safety installation;

monitoring the signal generated by the shaft monitoring device with the safety installation while the elevator is at a halt to take the elevator out of service in response to the signal; and performing a function check of the safety installation while the elevator is moving.

11. The method of claim 10, wherein the step of mounting the shaft monitoring device further comprises the step of mounting of the shaft monitoring device to the extent that it will survey the shaft pit.

12. The method of claim 10, wherein the step of mounting the shaft monitoring device further comprises the step of mounting of the shaft monitoring device to the extent that it will survey the top of the car.

* * * * *